United States Patent [19]

Fujii et al.

[11] Patent Number: 4,601,877

[45] Date of Patent: Jul. 22, 1986

[54] PRESS SINTERING PROCESS FOR GREEN COMPACTS AND APPARATUS THEREFOR

[75] Inventors: Tadaomi Fujii, Nara; Koji Kitazawa, Ashiya; Yutaka Tomono, Ibaraki; Tomio Takagi, Osaka; Josuke Kawachi, Ikoma, all of Japan

[73] Assignee: Hitachi Zosen Corporation, Osaka, Japan

[21] Appl. No.: 758,130

[22] Filed: Jul. 23, 1985

[30] Foreign Application Priority Data

Oct. 18, 1984 [JP] Japan ..... 59-220271

[51] Int. Cl.[4] ..... B22F 1/00

[52] U.S. Cl. ..... 419/42; 419/48; 419/49; 419/51; 65/18.1; 264/56; 264/319; 264/332

[58] Field of Search ..... 419/49, 56, 42, 48, 419/54, 55, 51; 65/18.1; 264/56, 319, 332

[56] References Cited

U.S. PATENT DOCUMENTS

| | | | |
|---|---|---|---|
| 4,341,557 | 7/1982 | Lizenby | 419/49 |
| 4,371,396 | 2/1983 | Larsson et al. | 419/52 |
| 4,428,906 | 1/1984 | Rozmus | 419/48 |
| 4,446,100 | 5/1984 | Adlerborn et al. | 419/49 |

*Primary Examiner*—Stephen J. Lechert, Jr.
*Attorney, Agent, or Firm*—Joseph W. Farley

[57] ABSTRACT

A green compact (17) preheated to a predetermined temperature in a heating furnace (16) is inserted into a container comprising a press table (20) and a hollow cylinder (25), and molten glass (33) is then placed into the container. The green compact (17) is uniformly pressed by a press rod (29) through the molten glass (33). The molten glass (33) is cooled by a coolant flowing through channels (22) and (26) formed in the press table (20) and the cylinder (25), whereby a solidified shell (34) is formed at the outer peripheral portion of the mass of glass. Finally, the shell (34) is taken out from the container, and the molten portion of glass (33) is transferred into a ladle (31) through a grating (30), leaving the compressed sintered product on the grating (30).

8 Claims, 4 Drawing Figures

PRESS SINTERING PROCESS FOR GREEN COMPACTS AND APPARATUS THEREFOR

FIELD OF THE INVENTION

The present invention relates to a press sintering process for green compacts, and more particularly to a hot isostatic press sintering process (HIP process) and to an apparatus therefor.

BACKGROUND OF THE INVENTION

The alloy prepared from powder materials by press sintering has a compacted structure, and various powder alloy materials can be used in combination in the form of a dispersion for preparing such alloy. Because of these advantages, the alloys of this type can be expected to have higher strength and higher toughness than those obtained by the melting process. The press sintering processes are therefore thought to be useful for developing new alloys. Similarly, new ceramics having high toughness are produced from powder ceramic materials also by press sintering.

The press sintering processes useful for this purpose include, for example, the powder vehicle process and molten bath process.

The powder vehicle process is described, for example, in "Nikkei Mechanical," p. 128, July 2, 1984, published by Nikkei-McGraw-Hill Co., Ltd. According to the publication, a green compact is embedded in a pressure medium powder which is not reactive with the compact and which is placed in a tubular mold having a bore extending centrally therethrough. The tubular mold is enclosed in a tubular heat insulator, which is provided with a heating induction coil on its outer periphery. A pair of press rods is inserted into the central bore of the tubular mold from its opposite ends, whereupon the green compact is heated by the induction coil. Consequently, the green mold is sintered while being subjected to pressure through the pressure medium powder.

However, the powder vehicle process has the following drawbacks.

(1) It is difficult to isostatically press the green compact because the pressure medium is a powder.

(2) The mold, which is to be heated from outside, needs to be heated to a temperature higher than the sintering temperature. Consequently, the mold must have an increased wall thickness and is difficult to design.

(3) The mold, which is adapted to be heated from outside, requires a prolonged period of time when to be heated to the specified temperature and is therefore low in productivity.

The publication, p. 129, also discloses the molten bath process which is free of the above drawbacks. With this process, a green compact is immersed in molten glass serving as a pressure medium and placed in a crucible. The crucible is placed into a pressure-resistant container having an open upper end, a bottom and an inside heater, and the open upper end is closed with a cap having a high-pressure gas inlet. The green compact is sintered as desired by being heated with the heater while being subjected through the molten glass to the pressure of the gas admitted through the cap inlet.

Nevertheless, the molten bath process has the following drawbacks.

(4) It is difficult to obtain a sufficient pressure because a gas is used as the pressure source, while the cap is difficult to seal off completely.

(5) Even if the clearance between the container and the cap can be sealed off completely, a gas pressure of thousands of atmospheres, when needed, requires the operation of a large compressor for a prolonged period of time. Along with the drawback (4), this drawback results in low productivity and an increased production cost.

SUMMARY OF THE INVENTION

An object of the present invention is to overcome the foregoing drawbacks and to provide a press sintering process for green compacts and an apparatus therefor.

According to a first aspect of the present invention, there is provided a press sintering process for a green compact comprising inserting the green compact into a pressing container after preheating the green compact to a predetermined temperature, placing into the container a solidifiable pressure medium melted by heating, pressing the green compact within the container by a press member through the pressure medium, cooling the container to solidify the outer peripheral portion of the pressure medium and form a solidified shell, taking out from the container the solidified shell containing the remaining portion of the pressure medium in a molten state, and taking out the compressed sintered product from the solidified shell.

According to a second aspect of the present invention, there is provided an apparatus which is suitable for practicing the above process. This apparatus comprises a pressing container including a movable cylinder having a central through bore and a stationary press table fitting in the central bore of the cylinder from one end thereof and slidable in sealing contact with the cylinder, a press rod insertable into the central bore of the cylinder from the other end thereof in sealing contact with the cylinder, and coolant channel means embedded in the container.

DESCRIPTION OF THE PREFERRED EMBODIMENTS

Figure 4:
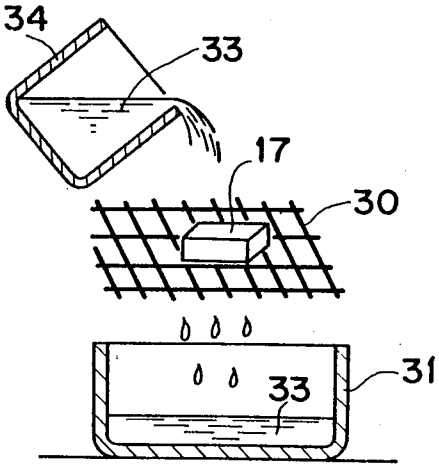
FIG. 4 is a view showing the step of taking out a sintered product.
Figure 3:
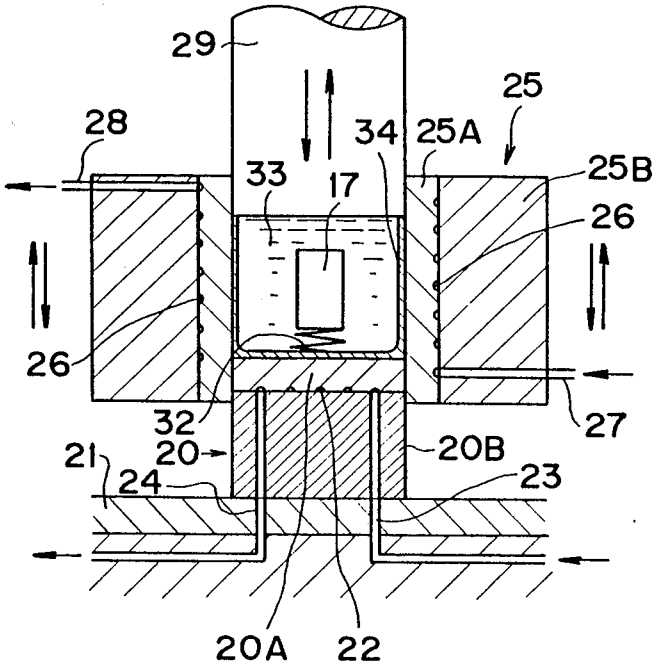
FIG. 3 is a view in vertical section showing a press sintering apparatus of the present invention.

With reference to FIG. 3 showing a press sintering apparatus, a press table 20 is placed on a base 21. The press table 20 comprises an upper portion 20A and a lower portion 20B. Provided between the two portions 20A and 20B is a cooling channel 22 in a zigzag or rectangular wavelike form and communicating with a cooling water pipe 23 and a cooling water discharge channel 24. The press table 20 and a hollow cylinder 25 fitting around the table 20 and vertically movable provide a high-pressure container. The cylinder 25 comprises an inner peripheral portion 25A and an outer peripheral portion 25B. A spiral cooling channel 26 communicating with a cooling water supply channel 27 and a cooling water discharge channel 28 is provided between the two portions 25A and 25B. A vertically movable press rod 29 is fittable into the central through bore of the cylinder 25 in sealing contact therewith.

The press sintering process to be practiced using the above apparatus will be described below.

Figure 1:
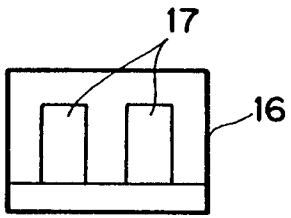
FIG. 1 is a diagram showing the step of preheating green compacts.
Figure 2:
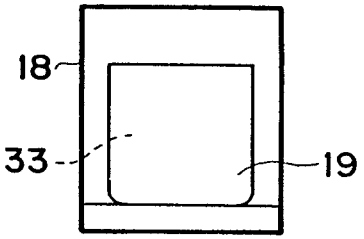
FIG. 2 is a diagram showing the step of preparing molten glass.

First, green compacts 17, for example, for producing high-speed tools of iron-base alloy are heated to a predetermined temperature (e.g. 1300° C.) within a heating furnace 16 as shown in FIG. 1. Glass is heated to the same temperature as above to a molten state in a crucible 19 within a heating furnace 18 as seen in FIG. 2. Next, the cylinder 25 is lowered and the press rod 29 is raised, and in this state the green compact 17 withdrawn from the furnace 16 is placed into the container and positioned above the press table 20, as supported by a support coil 32 as shown in FIG. 3. With the cylinder 25 thereafter raised, the molten glass 33 is poured into the central bore of the cylinder 25 from the crucible 19. Subsequently, the press rod 29 is lowered fittingly into the cylinder 25, whereby the green compact is compressed with a predetermined pressure through the molten glass 33. Since cooling water is being passed through the two cooling channels 22 and 26 at this time, the outer peripheral portion of the molten glass 33 is immediately cooled to form a solidified shell 34 to prevent the remaining molten portion of glass 33 from flowing out through the seal portion. Accordingly, when the press rod 29 is raised and the cylinder 25 lowered (or further raised) immediately after the compression, the solidified shell 34 can be taken out. Finally, the molten glass 33 is transferred from the shell 34 into a ladle 31 through a grating 30, leaving the compressed sintered product 17 on the grating 30. To prevent cracking due to rapid cooling, the product 17 may be slowly cooled in the heating furnace 16 when required. The molten glass 33 in the ladle 31 and the solidified shell 34 are reusable when heated. When a heating furance is used which is provided inside thereof with a grating, and a ladle or crucible positioned below the grating, the solidified shell containing the sintered product and molten glass may be placed on the grating and heated, whereby the glass can be melted again and the product removed at the same time.

The above press sintering process (improved HIP process) has the following advantages.

(a) The press sintering time is extremely short, so that the process achieves improved productivity. The conventional processes take 5 to 10 hours from the placement of green compact until the withdrawal of the product, whereas the present process can be practiced within 2 to 7 minutes.

(b) Because the green compact and the pressure medium are heated in furnaces which are separate from the press sintering apparatus, the power consumption can be reduced, while no seal is needed for high-pressure gas. The container can thefore be designed easily.

(c) The mechanical press work readily affords a high pressure for compression. The conventional molten bath process (high-pressure gas compression process) is limited to a pressure of up to 2000 to 3000 atmospheres, whereas an increased pressure of 5000 to 10000 atomospheres is applicable according to the present invention. The increased pressure gives products of improved quality and also makes it possible to sinter even powders which are not amenable to sintering.

(d) With use of the molten pressure medium, even green compacts of complicated shape can be uniformly compressed without entailing the problem of ingress of gas into the compact which is encountered with the conventional molten bath process.

(e) The extremely shortened sintering time inhibits the growth of crystals in the green compact being processed, giving a product of superfine crystalline structure.

While molten glass is used as the pressure medium for the green compact of metal powder, molten metal is usable for ceramic green compacts. Further when the green compact comprises a powder (e.g. of Ti or Al) which is degraded by oxidation during heating, the green compact may be vacuumpacked in a metal can before sintering.

What is claimed is:

1. A press sintering process for a green compact comprising inserting the green compact into a pressing container after preheating the green compact to a predetermined temperature, placing into the container a solidifiable pressure medium previously melted by heating, applying a mechanical pressing force to the green compact within the container solely through the pressure medium, the pressing force being produced by mechanical press means adapted to be in direct contact with the pressure medium, positively cooling the container to solidify the outer peripheral portion of the pressure medium and form a solidified shell, taking out from the container the solidified shell containing the sintered green compact and some pressure medium in the molten state, and taking out the compressed sintered product from the solidified shell.

2. A process as defined in claim 1 wherein the sintered product is taken out by transferring the molten portion of the pressure medium from the shell into a ladle through a grating.

3. A process as defined in claim 1 wherein the pressure medium is molten glass or molten metal.

4. A press sintering apparatus for green compacts comprising a pressing container including a movable cylinder with a central through bore and a stationary press table fitting in the central bore of the cylinder from one end thereof and slidable in sealing contact with the cylinder, a press rod insertable into the central bore of the cylinder from the other end thereof in sealing contact with the cylinder, and coolant channel means embedded in the container.

5. An apparatus as defined in claim 4 further comprising retaining means for supporting the green compact above the press table.

6. An apparatus as defined in claim 5 wherein the retaining means is a coil jig.

7. An apparatus as defined in claim 4 wherein the cylinder comprises an inner peripheral portion and an outer peripheral portion, and a spiral coolant channel communicating with a coolant supply channel and a coolant discharge channel is provided between the inner peripheral portion and the outer peripheral portion.

8. An apparatus as defined in claim 4 wherein the press table comprises an upper portion and a lower portion, and a coolant channel communicating with a coolant supply channel and a coolant discharge channel is provided between the upper table portion and the lower table portion.

* * * * *